US005361440A

United States Patent [19]

Buchbinder et al.

[11] Patent Number: 5,361,440

[45] Date of Patent: Nov. 8, 1994

[54] PLAY PIT BALL CLEANING DEVICE

[75] Inventors: Jay Buchbinder; Paul Molina, both of Huntington Beach, Calif.

[73] Assignee: Jay Buchbinder Industries, Inc., Long Beach, Calif.

[21] Appl. No.: 157,955

[22] Filed: Nov. 24, 1993

[51] Int. Cl.[5] ..... A63B 47/04

[52] U.S. Cl. ..... 15/21.2; 15/97.1

[58] Field of Search ..... 15/21.2, 97.1, 3.21; 134/6

[56] References Cited

U.S. PATENT DOCUMENTS

| | | | |
|---|---|---|---|
| 1,964,430 | 6/1934 | Eberts | 146/194 |
| 3,038,186 | 6/1962 | Davy | 15/21.2 |
| 3,083,389 | 4/1963 | Wittek | 15/97.1 |
| 3,733,633 | 5/1973 | Gustafson | 15/21.2 |
| 3,820,183 | 6/1974 | Gustafson et al. | 15/21.2 |
| 4,776,731 | 10/1988 | Briggs et al. | 406/153 |
| 4,809,381 | 3/1989 | Brandenburger et al. | 15/1.7 |
| 5,077,854 | 1/1992 | Moons | 15/21.2 |
| 5,139,577 | 8/1992 | Brock | 134/25.4 |

*Primary Examiner*—Edward L. Roberts
*Attorney, Agent, or Firm*—Christie, Parker & Hale

[57] ABSTRACT

A collection, washing and dispensing apparatus for lightweight balls. A pneumatic transport receives the balls and transports the balls to an elevated storage hopper which has an angled bottom surface terminating in a downchute for feeding the balls to a scrubbing element. The scrubbing element has a rotating drum mounted in a semicylindrical mating rack immersed in a fluid tight washtub. The opposing surfaces of the drum and rack are covered by a compressible pile to provide a friction engagement of balls between the drum and rack. The rotation of the drum urges the balls around the rack to an exit lip of the tub. A gravity feed race adjacent the lip carries the balls to a collection funnel. A sterilization spray is mounted over the race for spraying the balls. A pneumatic transport is connected to receive balls at the funnel for dispensing.

7 Claims, 5 Drawing Sheets

PLAY PIT BALL CLEANING DEVICE

BACKGROUND OF THE INVENTION

1. Field of the Invention

The present invention relates generally to the field of sanitary control of polystyrene ball filled play pits for infants and young children. More specifically the invention provides for pneumatically powered collection of polystyrene balls from the pit to a containment hopper employing gravity feed to a washing system which incorporates integrated frictional transport of the balls to a gravity feed sterilization and collection system followed by pneumatically powered return to the play pit.

2. Prior Art

Large rooms or flexible pits containing numerous lightweight polystyrene or polyurethane balls are now being used for amusement in many restaurants, parks, and other children's play areas. These pits are typically large enough to allow a child to become fully immersed in the lightweight balls without danger of suffocation and allows the child to burrow, tunnel, jump and otherwise play in the balls contained in the pit. As a result of the intimate contact between the balls and the children playing in the pits, the balls often become soiled with perspiration, salvia, dirt and/or foods carried by the children. Continuous use of the pits can create an unsanitary condition which renders the pits undesirable for use. Cleaning of the balls in the present play pits typically requires shoveling of the balls into secondary containers for transport to an alternative site for washing in standard clothes washing machines or by hand. Alternatively the balls are periodically replaced with new balls and discarded to avoid the necessity for cleaning. The present methods for cleaning the balls are inefficient, time consuming, and labor intensive resulting in significant cost to the operators of the play pits. Complete replacement of the balls on a periodic basis is similarly expensive and inefficient.

It is therefore desirable to provide a means for removing the lightweight balls from the pit, cleaning and sterilizing the balls and returning them to the pit in a semiautomated fashion to reduce the cost of operating such play pits and eliminating concerns regarding sanitation.

SUMMARY OF THE INVENTION

The present invention provides a system for collection, washing, sterilizing, and returning lightweight balls from a play pit. The apparatus incorporates a first pneumatic transport system having an input for collection of the balls from the play pit. The pneumatic transport includes a flexible conduit connected to an elevated storage hopper which receives the balls from the play pit for temporary storage. The elevated storage hopper has an angled bottom which urges the balls in the hopper to a downchute extending from the bottom of the hopper. Balls from the downchute are received in a scrubbing element which incorporates a rotating drum mounted in a concentric semicylindrical rack contained in a washing tub. The surface of the rotating drum and the semicylindrical rack have a fibrous pile surface and the difference in the radius of the drum and semicylindrical rack and mounting of the drum within the rack are established based upon the diameter of the lightweight balls whereby the rack and drum frictionally engage the balls. Rotation of the drum within the rack draws balls from the downchute through the washing tub allowing the balls to roll over the lip of the tub opposite the downchute. A washing solution partially fills the tub which in combination with the scrubbing action provided by the pile surfaces of the rack and drum effectively washes the balls as they pass through.

After leaving the tub a gravity feed race carries the balls from the lip of the tub to a collection funnel. A spray bar mounted over the race is employed for spraying a sterilizing fluid on the balls. Perforations in the race allow the sterilizing fluid to pass through the race for collection in a basin allowing closed loop recirculation of the sterilizing fluid by way of a pump connecting the collection basin and spray bar through a filter. A second pneumatic transport means is connected to receive the balls at the funnel for returning the balls to the play pit.

A BRIEF DESCRIPTION OF THE DRAWINGS

FIG. 1 is a pictorial view of a first embodiment of the invention showing the elevated storage hopper, scrubbing element drum, perforated gravity feed race and flexible conduits for pneumatic transport collection and return of balls to the play pit;

FIG. 2*a* is a side cut-away view of the right side of FIG. 1;

FIG. 2*b* is a side cut-away view of the left side of the FIG. 1;

DETAILED DESCRIPTION OF THE INVENTION

Figure 1:
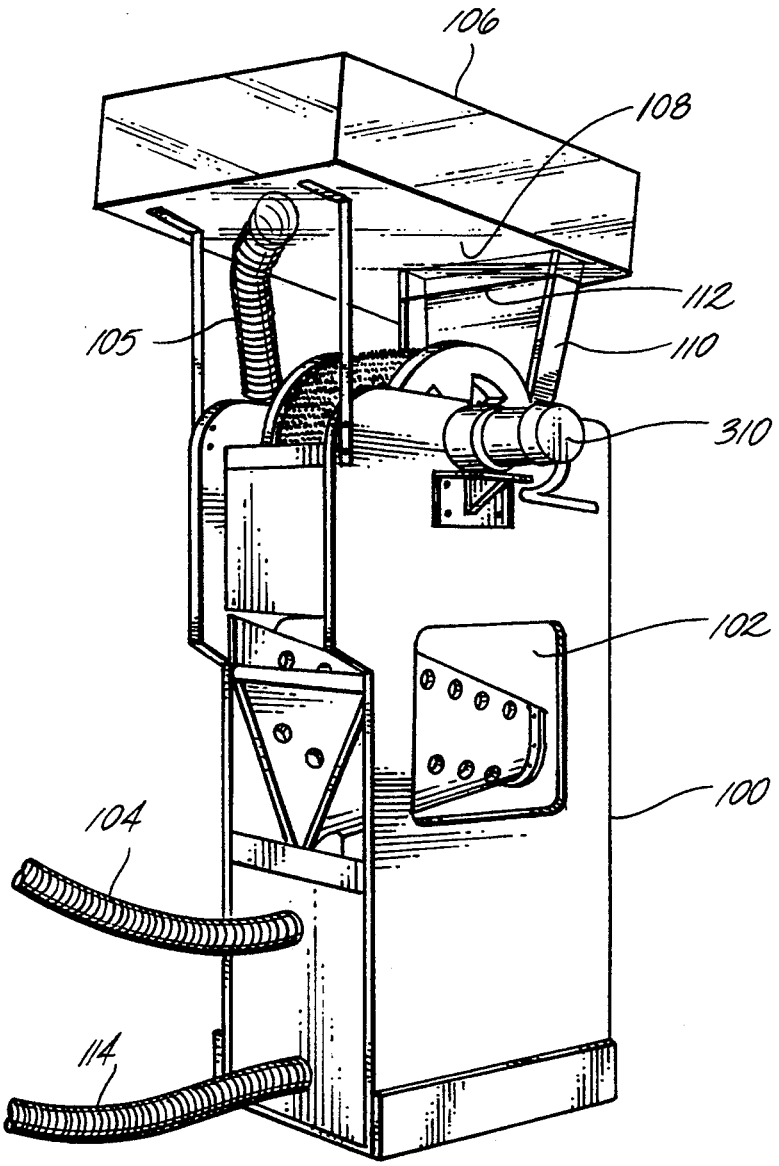

An exemplary embodiment of the present invention is shown in FIG. 1. The apparatus is mounted in a self-contained cabinet 100 which includes apertures 102 covered with clear window such as plexiglass or Lexan (polycarbonate) for viewing of portions of the process by patrons. Balls from the play pit are extracted through a first conduit 104 and are transported pneumatically to an elevated storage hopper 106. In the embodiment shown in the drawings the storage hopper is fabricated from clear Lexan to allow patrons to see the balls present in the hopper. The lower surface of the hopper 108 is downwardly angled about 10° from the front of the apparatus to the rear of the apparatus to allow gravity feed of the balls in the hopper to a downchute 110 attaching to an aperture 112 in the bottom of the hopper. Balls descending through the downchute are processed by a scrubbing element and sterilizing system shown in detail in FIGS. 2*a* and 2*b*.

Figure 3:
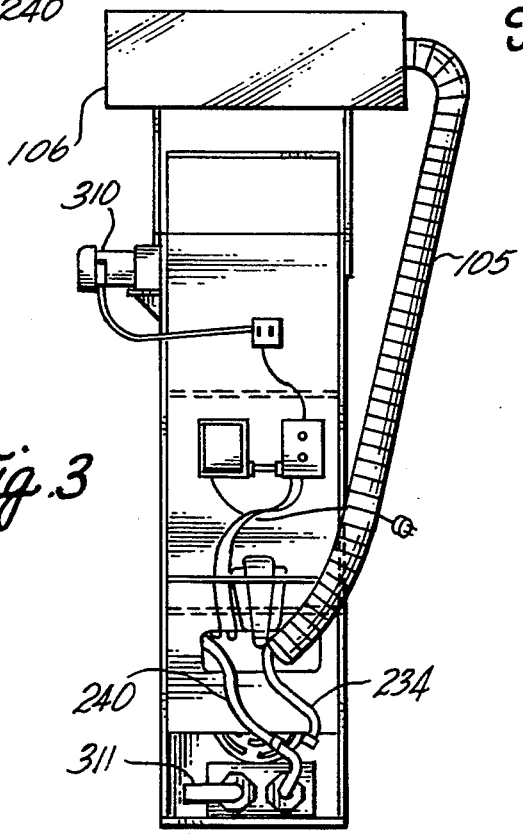
FIG. 3 is a rear view of the embodiment of FIG. 1.

Balls descending through the downchute are received in a washing tub 211 which is water tight and contains a washing solution. A drum 212 is concentrically mounted within a semicylindrical rack 210 in the tub. The surface 214 of the drum and the rack 216 in the tub are covered with a compressible fibrous mat having a pile depth of approximately $\frac{3}{8}$ to $\frac{1}{2}$ inch. The difference in diameter between the drum and semicylindrical rack is determined based on the diameter of the balls to be processed and provides frictional engagement between the compressed pile of the fibrous surfaces of the drum and rack with the balls. Rotation for the drum in the embodiment shown in the drawings is provided by an electric motor and gear reduction unit 310 as best seen in FIG. 3 and schematically represented in FIG. 4.

Balls drawn from the downchute by frictional engagement with the drum and cylindrical rack are urged through the washing tub by rotation of the drum and emerge at a lip 218 of the tub opposite the downchute.

The washing solution in the tub in combination with the scrubbing action provided by the pile of the fibrous material on the surfaces of the drum and rack effectively cleans the balls to remove any dirt or other contaminants. Balls exiting the tub transition through a gravity fed race 220 which in the embodiment shown comprises a free fall chute 222, a spray rack 224, and a collection channel 226. A variably positionable spray head 228 is mounted over the spray rack portion of the race and highly atomized sterilizing solution is sprayed on the balls as they move through the race under gravity feed. Balls descending through the race are collected and deposited in a funnel 230 which is connected to a pneumatic transport system for returning the balls through flexible conduit 114 to the pit, as shown in FIG. 1.

Figure 2A:
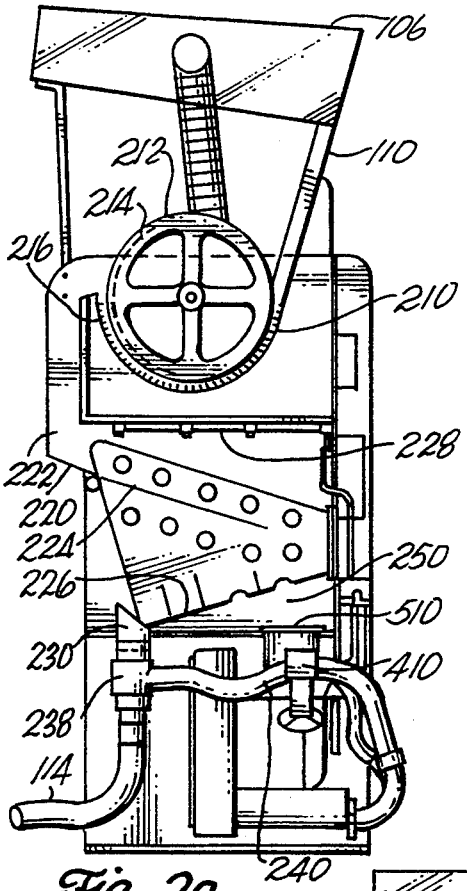
Figure 2B:
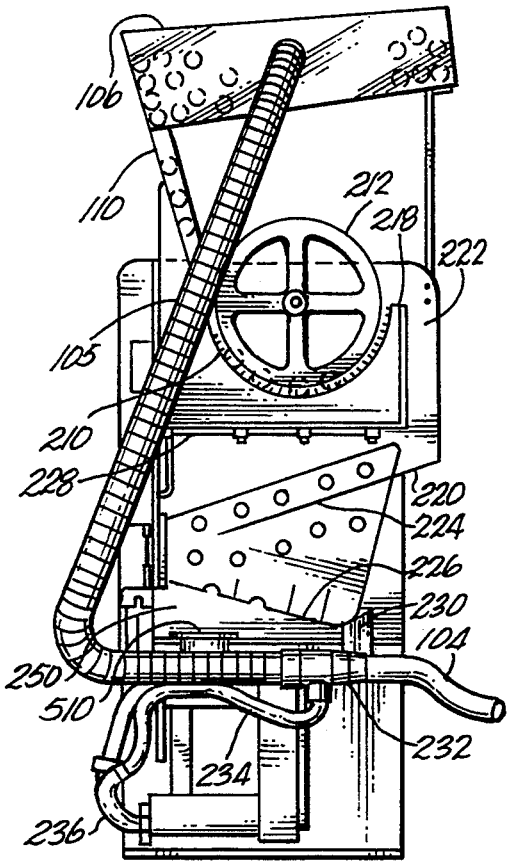

The pneumatic transport system employed in the present invention for collection and return of the balls comprises flow inducers operating in conjunction with a pressure fan. The inducer 232 as best seen in FIG. 2*b* attaches to the flexible conduit 104 and incorporates a pressure line 234 receiving air from a fan 236. A flexible conduit 104*a* extends from the first inducer to the elevated hopper.

A second inducer 238 is connected to the funnel receiving balls from the gravity race and to flexible conduit 114 for return of balls to the play pit. A second pressure line 240 from the fan attaches to the second inducer.

Figure 4:
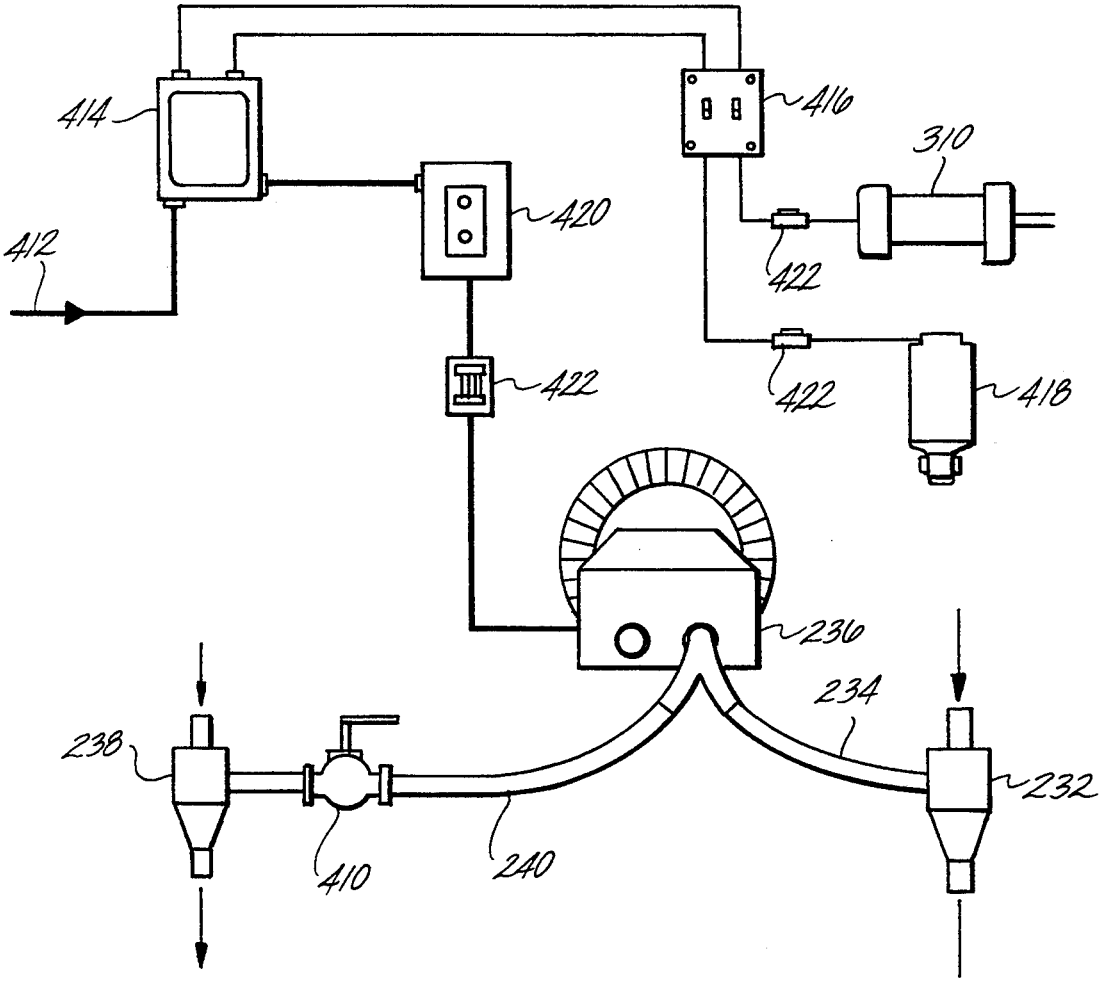
FIG. 4 is a schematic diagram of the electrical and pneumatic system for the embodiment of the invention shown in FIG. 1.
Figure 5:
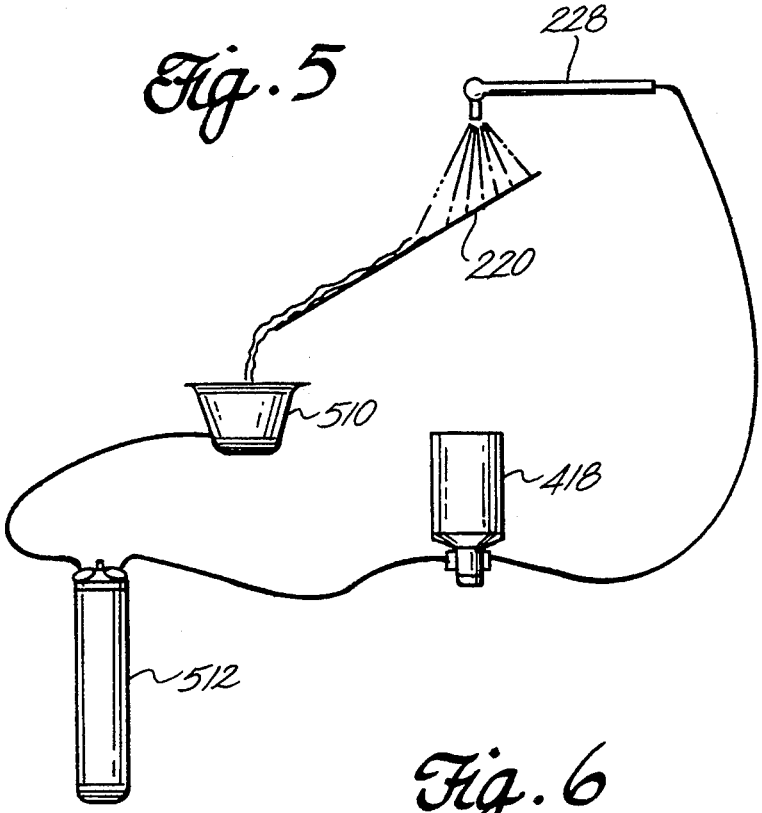
FIG. 5 is a schematic diagram of the closed loop sterilizing fluid, spray, collection and return system.

The pneumatic system employed for transport of the lightweight balls from a play pit to the elevated hopper of the invention and to return the balls to the play pit is shown schematically in FIG. 4. In the embodiment shown in the drawings, a 510 cubic foot per minute blower is employed for the pressure fan 236. Alternative embodiments of the invention employ a high pressure, low volume gas source for pneumatic power source as a replacement for the high volume, low pressure blower arrangement in the embodiment shown. The first pneumatic inducer 232 comprises a six-inch eductor providing sufficient pressure reduction in flexible conduit 104 to draw lightweight balls from the pit into the invention and sufficient pressure in flexible conduit 105 to transport the balls into the elevated hopper.

The second inducer 238 comprises a four-inch eductor which provides sufficient pressure deferential to return the lightweight balls to the pit through flexible conduit 114. In the present embodiment an airflow control valve 410 is employed to shut off pressurized flow from the fan 236 through conduit 240 to the second inducer when not in use and control exit speed of balls transported by the system. As best seen in FIG. 3, a filter 311 is provided on the air inlet to the blower. FIG. 4 also shows schematically the electrical interconnections of the embodiment of the present invention. Power input 412 is provided to a common distribution box 414 for routing to dual switch assembly 416 controllably providing power to the drum rotation motor 310 and sterilization fluid recirculation pump 418. Power from the distribution box is also provided through switch 420 to the high flow blower. Circuit breakers and magnetic overload relays generally designated 422 are provided for short circuit protection of the electrical components.

Figure 6:
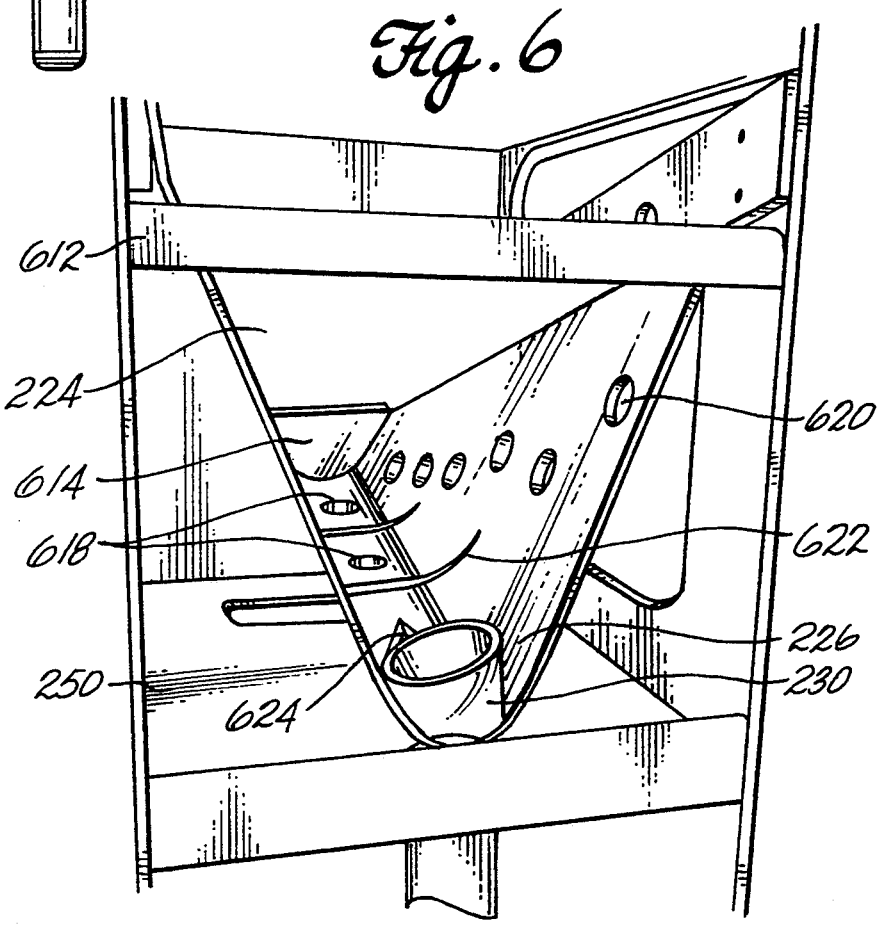
FIG. 6 is a detailed view of the gravity race and collection funnel for the embodiment of the invention in FIG. 1.

Efficiency of the present invention is enhanced through the use of a recirculating system for the sterilizing spray applied to the balls. Balls traveling down the race 220 receive a high pressure sterilizing spray from nozzle assembly 228. Fluid drains from the race into a catch basin 510 from which fluid is drawn through a micropore filter 512 by recirculation pump 418 to be returned to the spray bar assembly. In the embodiment shown, a 5 micron filter is employed. Reuse of the filtered fluid allows continuous operation of the system for extended periods of time without replacement or loss of the sterilizing fluid. As shown in FIGS. 2*a* and 2*b* the catch basin is installed in a fluid tight compartment 250 which captures drainage of the sterilizing fluid from the race. Details of the race employed in the present embodiment are shown in FIG. 6. Balls dropping from the lip 218 of the washing tub through chute 222 hit spray rack 224 and are carried downwardly under the spray nozzles 228. The ramp tapers from an edge portion 612 proximate the location of first contact of the balls to an aperture 614 through which the balls drop into channel 226 for transport to the exit funnel 230. Channel 226 contains apertures 618 which are located directly over the catch basin to allow direct flow of the majority of the sterilizing fluid sprayed onto the balls directly into the catch basin. Additional apertures 620 in the sides of channel 226, slots 622 in the bottom of the channel and triangular aperture 624 immediately prior to the exit funnel provide additional drainage for the sterilizing fluid into the fluid tight chamber 250 for ultimate flow into the catch basin.

Figure 7:
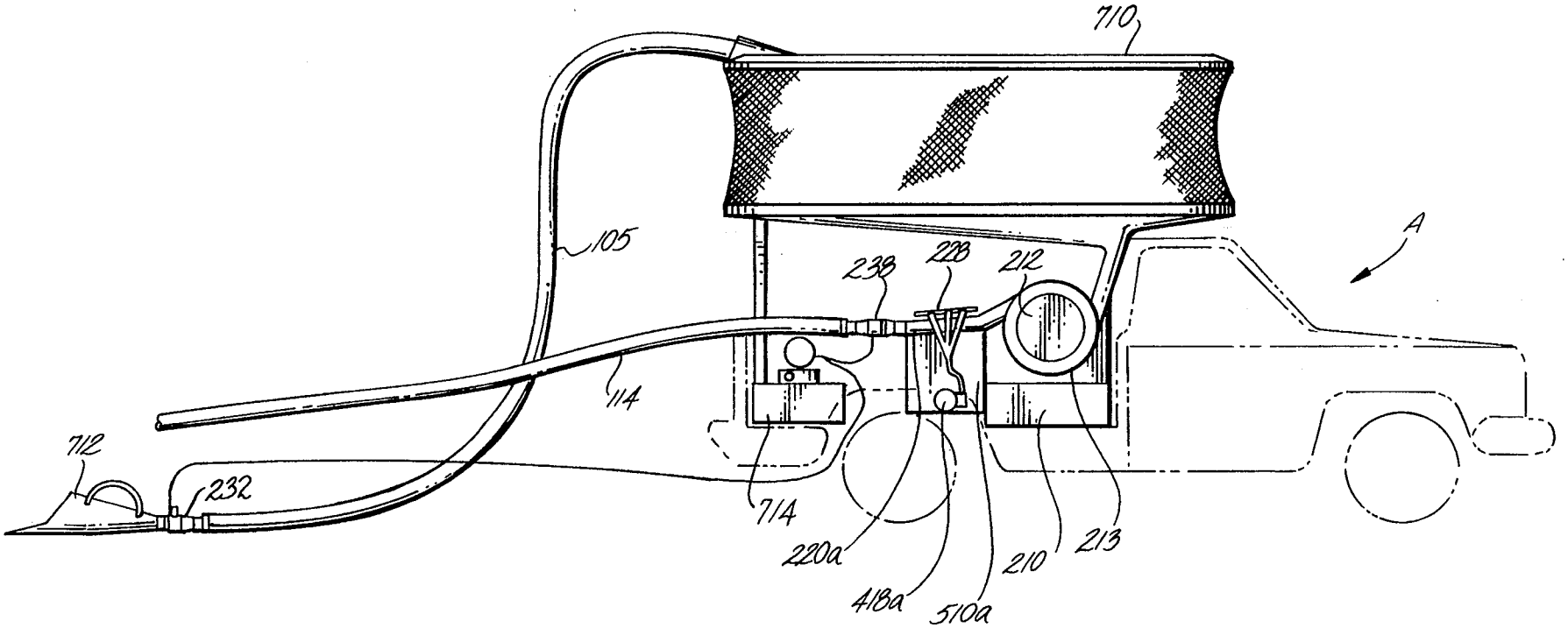
FIG. 7 is a schematic diagram of a second truck mounted embodiment of the invention for portable use.

A second embodiment for portable use of the present invention is shown in FIG. 7. The present invention is truck mountable to allow play pits located at various sites to be serviced on a scheduled basis by a single cleaning unit. Wash tub 210 is mounted in the bed of a truck generally designated A. The rotating drum and mating semicylindrical wash rack are mounted in the wash tub to receive balls from a hopper 710 mounted on supports over the truck bed and cab. In the embodiment shown in the drawings, the hopper comprises a mesh-sided unit which is collapsible when not in use to provide better aerodynamics.

Lightweight balls from the play pit are withdrawn using a scoop 712 connected to the first pneumatic transport system. Due to the extended distances which may be required for operation of the system a high pressure, low volume gas source, such as a compressor and pressure tank 714, is provided for airflow to the first inducer. Balls transported from the pit pass through flexible conduit 105 to a top entry on the extended hopper.

Balls departing the scrubber unit enter the gravity feed race 220*a*. Sterilizing spray nozzle assemblies 228 are mounted over the race for sterilization of the balls. Sterilizing fluid draining from the balls is captured in basin 510*a*. In the embodiment shown in FIG. 7 the recirculation pump comprises an immersible unit 418*a* with integral micropore filter. After sterilization the balls are returned to the play pit through the second pneumatic transport system using inducer 238 also connected to the compressor and pressure tank.

The truck mounted unit of FIG. 7 may be employed to remove balls from the play pit for transportation by routing of the return flexible conduit 114 into the elevated hopper on the truck. The mesh-sided hopper is of sufficient capacity, in the embodiment shown in the drawings, to contain all of the balls from a play pit.

Having now described the invention in detail as required by the patents statutes, those skilled in the art will recognize modifications and substitutions to the embodiments disclosed for use in particular applications. Such modifications and substitutions are within the scope and intent of the present invention as defined in the following claims.

What is claimed is:

1. A collection, washing, and dispensing apparatus for lightweight balls comprising:

a first pneumatic transport means having an input for receiving the balls and an output;

an elevated storage hopper connected to the output of the first transport means, the hopper having an angled bottom surface terminating in a downchute for gravity feed of balls from the hopper into the downchute;

a scrubbing element having a rotating drum mounted in a semicylindrical mating rack immersed in a fluid tight wash tub containing washing solution, the semicylindrical rack attached to receive balls from the downchute, the drum mounted with respect to the rack in spaced relation to frictionally engage the received balls between the drum and rack, rotation of the drum urging the balls around the rack to an exit lip of the tub;

a gravity feed race mounted proximate the exit lip, the race carrying balls to a collection funnel;

a sterilization spray means mounted over the race for spraying balls with a sterilizing fluid; and a second pneumatic transport means connected to receive balls at the funnel for dispensing.

2. An apparatus as defined in claim 1 wherein the race contains apertures therethrough and further comprising a collection basin for the sterilizing fluid.

3. An apparatus as defined in claim 2 further comprising a return circulation pump connected to receive fluid from the collection basin and provide fluid to the spray means.

4. An apparatus as defined in claim 1 wherein opposing surfaces of the drum and rack comprise fibrous mat having compressible pile for enhanced frictional engagement of balls between the drum and rack.

5. An apparatus as defined in claim 1 wherein the first and second pneumatic transport means each comprise an inducer junction receiving pressurized air from a pneumatic blower and interconnected to a flexible conduit for carrying balls to be transported.

6. An apparatus as defined in claim 1 wherein the scrubbing element, race, and spray means are mounted in a truck bed and the storage hopper is suspended over the truck bed.

7. A collection, washing and dispensing apparatus for lightweight balls comprising:

a first pneumatic transport means having a first inducer junction connected to a pressure blower and a first flexible conduit having an input for receiving balls and an output;

an elevated storage hopper connected to the output of the first flexible conduit, the hopper having an angled bottom surface terminating in a downchute for gravity feed of the balls in the hopper into the downchute;

a scrubbing element having a rotating drum and a semicylindrical mating rack mounted in a fluid tight washing tub containing a washing solution, the rack attached to receive balls from the downchute and the drum and rack spaced to frictionally engage the received balls therebetween, the opposing surfaces of the drum and rack comprising fibrous mat having a compressible pile, rotation of the drum urging balls around the rack to an exit lip;

a gravity feed race receiving balls from the exit lip and carrying the balls to a collection funnel;

a sterilization spray means mounted over the race for spraying the balls with sterilizing fluid, the race perforated for drainage of the sterilizing fluid;

a collection tub mounted under the race for collection of sterilizing fluid;

a return pump having an input connected to the collection basin and an outlet connected to the spray means; and a second pneumatic transport means having a second inducer junction connected to the pressure blower and a second flexible conduit connected to the funnel to receive the balls for dispensing.

* * * * *